US007473052B2

(12) United States Patent
Hall et al.

(10) Patent No.: US 7,473,052 B2
(45) Date of Patent: Jan. 6, 2009

(54) APPARATUS, SYSTEM, AND METHOD FOR IN SITU PAVEMENT RECYCLING

(76) Inventors: David R. Hall, 2185 S. Larsen Parkway, Provo, UT (US) 84606; Joe R. Fox, 2185 S. Larsen Parkway, Provo, UT (US) 84606

( * ) Notice: Subject to any disclaimer, the term of this patent is extended or adjusted under 35 U.S.C. 154(b) by 528 days.

(21) Appl. No.: 11/163,615

(22) Filed: Oct. 25, 2005

(65) Prior Publication Data

US 2006/0198701 A1 Sep. 7, 2006

Related U.S. Application Data

(63) Continuation-in-part of application No. 11/070,411, filed on Mar. 1, 2005, now Pat. No. 7,223,049.

(51) Int. Cl.
*E01C 23/09* (2006.01)

(52) U.S. Cl. ..... 404/75; 404/83; 404/84.05

(58) Field of Classification Search ..... 404/72–118
See application file for complete search history.

(56) References Cited

U.S. PATENT DOCUMENTS 2,407,976 A * 9/1946 Curtis et al. ..... 173/186
3,217,620 A * 11/1965 Mindrum et al. ..... 404/90
3,361,042 A 1/1968 Cutler
3,625,120 A * 12/1971 Nagy ..... 404/107
3,732,023 A 5/1973 Rank
3,904,245 A * 9/1975 Clarke ..... 299/37.4
3,970,404 A 7/1976 Benedetti
3,989,401 A 11/1976 Moench
4,018,540 A 4/1977 Jackson
4,104,736 A 8/1978 Mendenhall
4,124,325 A 11/1978 Cutler
4,172,679 A 10/1979 Wirtgen
4,195,946 A 4/1980 Swisher
4,198,177 A * 4/1980 Ray et al. ..... 404/75
4,335,975 A 6/1982 Schoelkopf
4,347,016 A 8/1982 Sindelar
4,407,605 A 10/1983 Wirtgen
4,453,856 A 6/1984 Chiostri
4,473,320 A 9/1984 Register
4,534,674 A 8/1985 Cutler
4,594,022 A 6/1986 Jeppson
4,668,017 A 5/1987 Peterson
4,676,689 A 6/1987 Yant
4,784,518 A 11/1988 Cutler
4,793,730 A 12/1988 Butch
4,968,101 A 11/1990 Bossow (Continued)

*Primary Examiner*—Raymond W Addie
(74) *Attorney, Agent, or Firm*—Daniel P. Nelson; Tyson J. Wilde

(57) ABSTRACT

A system for recycling pavement constituents in situ, includes a vehicle for traversing the pavement constituents comprising a container for storing and preserving heated pavement rejuvenation materials and at least one heating element adapted to heat the pavement rejuvenation materials above their working temperature. A dispensing element is in communication with the container for dispensing the pavement rejuvenation materials to the pavement constituents. The vehicle also supports at least one mixing element which is adapted to mix in situ the pavement constituents and the heated pavement rejuvenation materials together in such a manner that the pavement constituents are raised to a working temperature. The system also comprises a compaction element for compacting the pavement constituents.

17 Claims, 15 Drawing Sheets

U.S. PATENT DOCUMENTS 5,366,320 A 11/1994 Hanlon
5,544,971 A * 8/1996 Huege et al. ..... 404/72
5,549,457 A * 8/1996 Flores et al. ..... 404/84.05
5,556,225 A 9/1996 Marino
5,765,926 A 6/1998 Knapp
5,791,814 A 8/1998 Wiley
6,076,895 A * 6/2000 Ino et al. ..... 299/41.1
6,149,342 A * 11/2000 Phillips ..... 404/90
6,152,648 A * 11/2000 Gfroerer et al. ..... 404/84.05
6,158,920 A 12/2000 Malot
6,371,689 B1 4/2002 Wiley
6,623,207 B2 9/2003 Grubba
6,695,530 B2 * 2/2004 Crupi ..... 404/91
6,769,836 B2 8/2004 Lloyd

* cited by examiner

APPARATUS, SYSTEM, AND METHOD FOR IN SITU PAVEMENT RECYCLING

RELATED APPLICATIONS

This Patent application is a continuation-in-part of U.S. patent application Ser. No. 11/070,411 filed on Mar. 1, 2005, now U.S. Pat. No. 7,223,049; and entitled Apparatus, System, and Method for Directional Degradation of a Paved Surface, which is herein incorporated by reference in its entirety.

BACKGROUND OF THE INVENTION

1. Field of the Invention

The present invention relates to road resurfacing equipment and more particularly to apparatus, systems and methods for recycling a paved surface in situ.

2. Background

Asphalt is the most recycled material in the United States. In fact, more than 73 million tons of asphalt pavement removed each year during highway widening and resurfacing projects is reused as pavement. Such recycling efforts conserve natural resources, decrease construction time, minimize the impact of asphalt plant operations on the environment, and reduce reliance on landfills. Further, research shows that the structural performance of mixtures integrating reclaimed asphalt pavement ("RAP") is equal to, and in some instances better than, virgin asphalt pavement.

A process for recycling a paved surface may include mechanically breaking up a paved surface, applying fresh asphalt or asphalt rejuvenation materials to the broken pieces, depositing the mixture over the road surface, and compacting the mixture to restore a smooth paved surface. In some cases, broken asphalt may be removed from a road surface, treated off location, and then returned and compacted. By enabling the majority of road surface excavation and renovation to occur through a continuous operation in situ, road recycling processes reduce manpower, time and resources required with conventional road resurfacing techniques.

In some cases, a paved surface may be pre-heated to facilitate pavement removal as well as to increase thermal bonding between new and reclaimed pavement constituents. The low heat conductivity of asphalt and its susceptibility to damage from scorching or overheating, however, creates a dilemma in pavement recycling. In some cases, intense heat must be applied to bring the full depth of the pavement to a workable temperature while the pavement surface must be protected from scorching or overheating.

To overcome this problem, many conventional road recycling processes require heating equipment to make several passes over the same section of roadway in order to heat and work the pavement to a sufficient depth. This procedure is inefficient, time-consuming, and results in most of the heat being concentrated at the pavement surface, as opposed to a uniform distribution through the full depth of the paved surface. Other road recycling processes use multiple heating units that each operate at a temperature below the asphalt burning point. A large number of such units are required to achieve the desired heat penetration, thereby increasing the amount and cost of recycling equipment needed to repair a paved surface Accordingly, what are needed are improved apparatus, systems, and methods for in situ pavement recycling. More particularly, apparatus, systems, and methods are needed allowing application of higher temperatures to a paved surface in situ, while providing more uniform heat distribution and a reduced likelihood of burning, scorching, or other damage.

Beneficially, such a system would improve the bond between new and recycled pavement constituents, reduce the amount of new pavement materials needed to rejuvenate a paved surface, facilitate immediate pavement finishing processes, and increase the structural integrity of the resulting recycled paved surface. Such apparatus, systems, and methods are disclosed and claimed herein.

SUMMARY OF THE INVENTION

Consistent with the foregoing, and in accordance with the invention as embodied and broadly described herein, a system for recycling pavement constituents in situ is disclosed. A vehicle for traversing the pavement constituents has a container for storing heated pavement rejuvenation materials and there is at least one heating element adapted to heat the pavement rejuvenation materials within the container. A dispensing element is in communication with the container for dispensing the pavement rejuvenation materials to the pavement constituents on a road bed. The vehicle also supports at least one mixing element which is adapted to mix in situ the pavement constituents and the heated pavement rejuvenation materials together in such a manner that the pavement constituents are raised to a working temperature. The system also comprises a compacting element for compacting the resulting mixture of pavement constituents and pavement rejuvenation materials into a new road surface.

In certain aspects of the present invention the at least one mixing element rotates on an axis normal to a road bed. The mixing element may be further adapted for independent movement to avoid obstacles on the road bed, such as manholes, tracks, utilities, and curbs. The mixing element may be adapted to move independently of other mixing elements also supported by the vehicle in a vertical direction, horizontal direction, circular direction, and/or an angular direction. The mixing element may be supported by the vehicle in a reducing environment, which is adapted to prevent oxidation of the pavement constituents and/or the pavement rejuvenation materials. The reducing environment may further comprise a reduction source selected from the group consisting of an exhaust gas, a rich-burning flame, or a reducing gas. Mixing elements may be selected from the group consisting of mills, degradation elements, screeds, rakes, tongs, or drums.

The dispensing element may be formed in the mixing element. At least a second dispensing element may be in communication with a supply selected from the group consisting of water, polymers, surfactant, and combinations thereof. The second dispensing element may be adapted to dispense the supply into the pavement constituents.

The vehicle may also support at least one degradation element adapted to degrade a paved surface into pavement constituents. The at least one degradation element may be spaced within a predetermined distance from the mixing element wherein the predetermined distance controls the maximum size of the pavement constituents.

The container on the vehicle may be adapted to store the heated pavement rejuvenated materials in a reducing environment. The heating elements adapted to heat the pavement rejuvenation materials may be selected from the group consisting of radiant heaters, hot air heaters, convection heaters, microwave heaters, direct flame heaters, and combinations thereof. The vehicle may also support at least another heating element, which may be selected from the same group, to aid in heating the pavement constituents to a working temperature. The working temperature may be between 200° F. to 1100° F., an ideal working temperature may depend on the type and size of the pavement constituents as well as other factures like climate.

In another aspect of the present invention a method includes recycling pavement in situ. The method comprises the steps of degrading a paved surface to produce pavement constituents; heating the constituents to a working temperature by simultaneously dispensing heated pavement rejuvenation materials and mixing the pavement constituents with the heated pavement rejuvenation material; and compacting the resulting mixture of pavement constituents and pavement rejuvenation materials into a new road surface.

The mixing may be accomplished by a plurality of mixing elements adapted to rotate on an axis normal to a road bed. The maximum constituents size may be controlled by the distance between the plurality of mixing element and a plurality of degradation elements. The heated pavement rejuvenation materials may be stored in a reducing environment before they are dispensed and mixed with the pavement constituents. The heating may be performed in a reducing environment.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment in accordance with the present invention. Thus, use of the phrase "in one embodiment," "in an embodiment," and similar language throughout this specification may, but does not necessarily, all refer to the same embodiment.

Furthermore, the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

In the following description, numerous specific details are disclosed to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

In this application, "pavement" or a "paved surface" refers to any artificial, wear-resistant surface that facilitates vehicular, pedestrian, or other form of traffic. Pavement may include composites containing oil, tar, tarmac, macadam, tarmacadam, asphalt, asphaltum, pitch, bitumen, minerals, rocks, pebbles, gravel, sand, polyester fibers, Portland cement, petrochemical binders, or the like. The term "degrade" is used in this application to mean milling, grinding, cutting, ripping apart, tearing apart, or otherwise taking or pulling apart a pavement material into smaller constituent pieces. Similarly, the term "pavement constituents" is used to mean any materials or components used to create a paved surface, including new or reclaimed materials, or combinations thereof.

Figure 1:
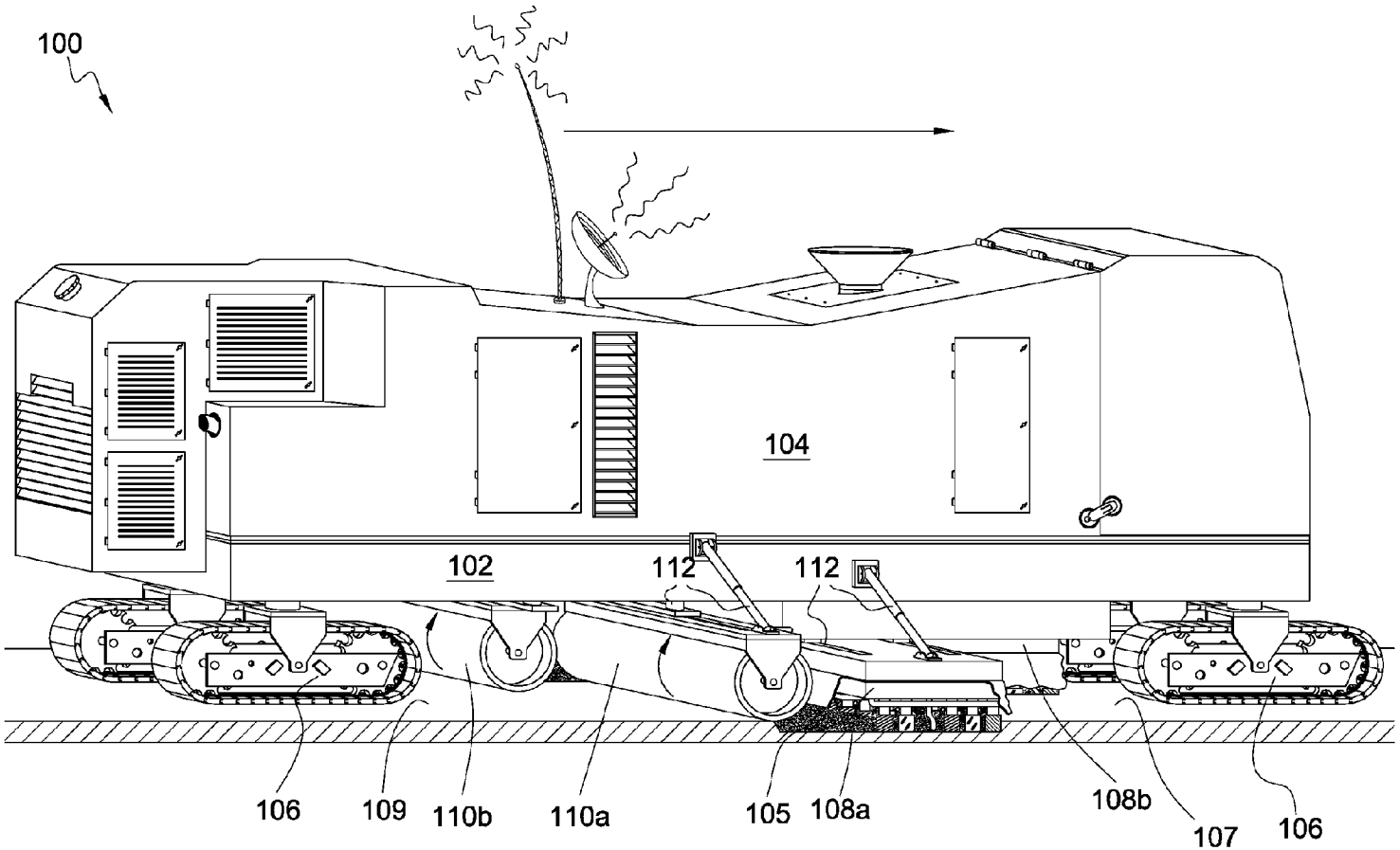
FIG. 1 is a perspective view of one embodiment of an apparatus for recycling pavement in situ in accordance with the present invention.

Referring to FIG. 1, one contemplated embodiment of an apparatus 100 for use in pavement recycling applications is illustrated. In general, an apparatus 100 may include a frame 102, a shroud 104 or cover 104 enclosing various internal component of the apparatus 100, and a translation mechanism 106, such as tracks, wheels, or the like, to translate the apparatus 100 along a surface. The translation mechanism 106 may include several sets of tracks, for example, which may be vertically adjusted with respect to the frame 102 to adjust the slant or elevation of the apparatus 100, and to adjust for varying elevations, slopes, and contours of the underlying road surface.

The apparatus 100 may include one or more heating and mixing assemblies 108*a*, 108*b* as will be described with additional specificity with respect to FIGS. 3 and 4, which may be used to simultaneously heat and mix pavement constituents 105 for compaction into a new or recycled road surface 109. In selected embodiments, a first heating and mixing assembly 108*a* may be extended and retracted with respect to one side of the apparatus 100 and a second heating and mixing assembly 108*b* may be extended and retracted with respect to a second side of the apparatus 100, thereby allowing the heating and mixing assemblies 108*a*, 108*b* to sweep over an area significantly wider than the apparatus 100. In selected embodiments, the width of each heating and mixing assembly

108*a*, 108*b* may approximate the width of the apparatus 100. In such embodiments, the assemblies 108*a*, 108*b* may sweep over a road width that is approximately twice the apparatus width when the assemblies 108*a*, 108*b* are fully extended from each side of the apparatus 100. The extension and retraction of the assemblies 108*a*, 108*b* will become more readily apparent from the description of FIG. 5.

Figure 3:
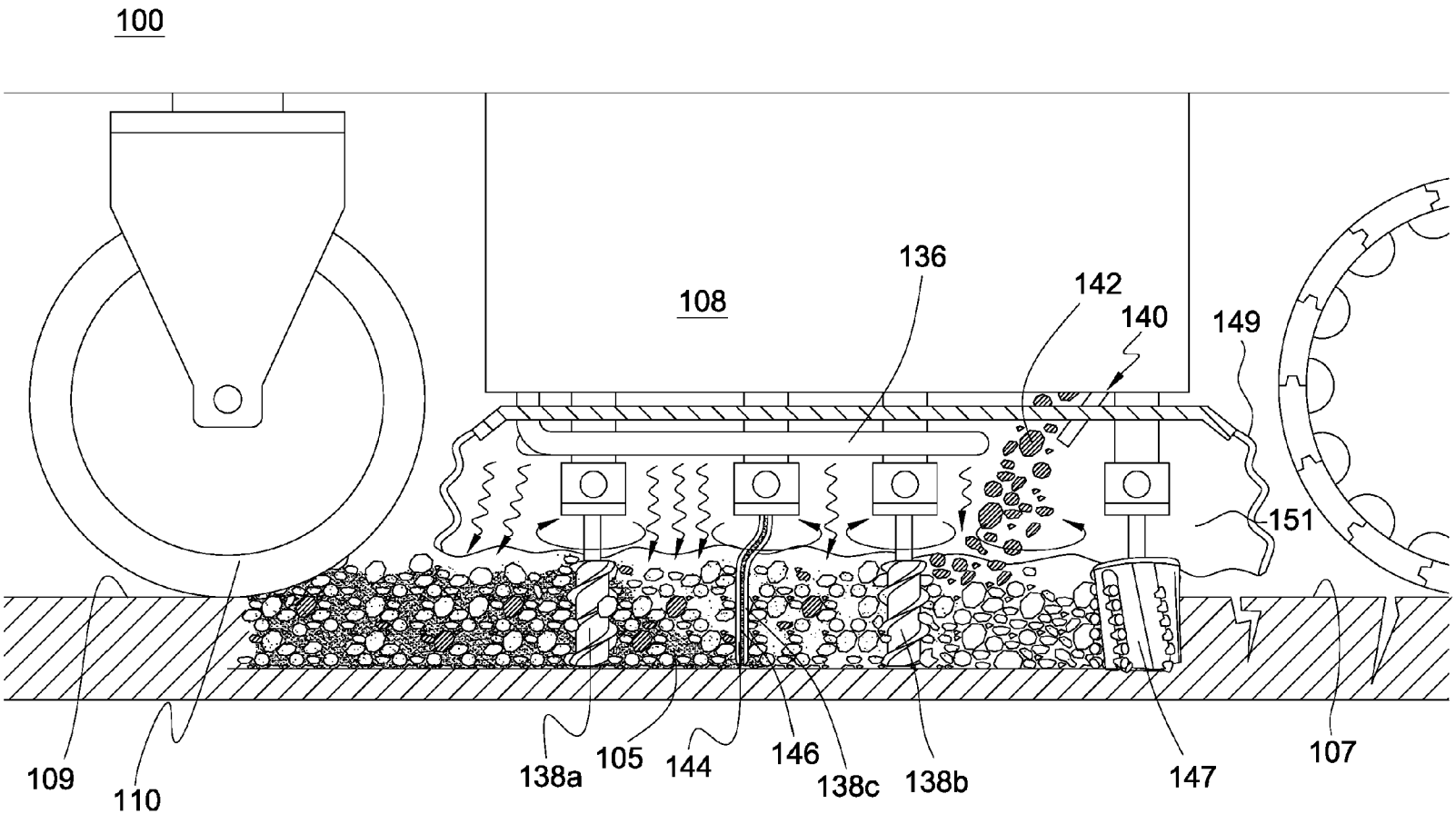
FIG. 3 is a side view of one embodiment an assembly comprising a mixing and heating mechanism in accordance with the invention.
Figure 4:
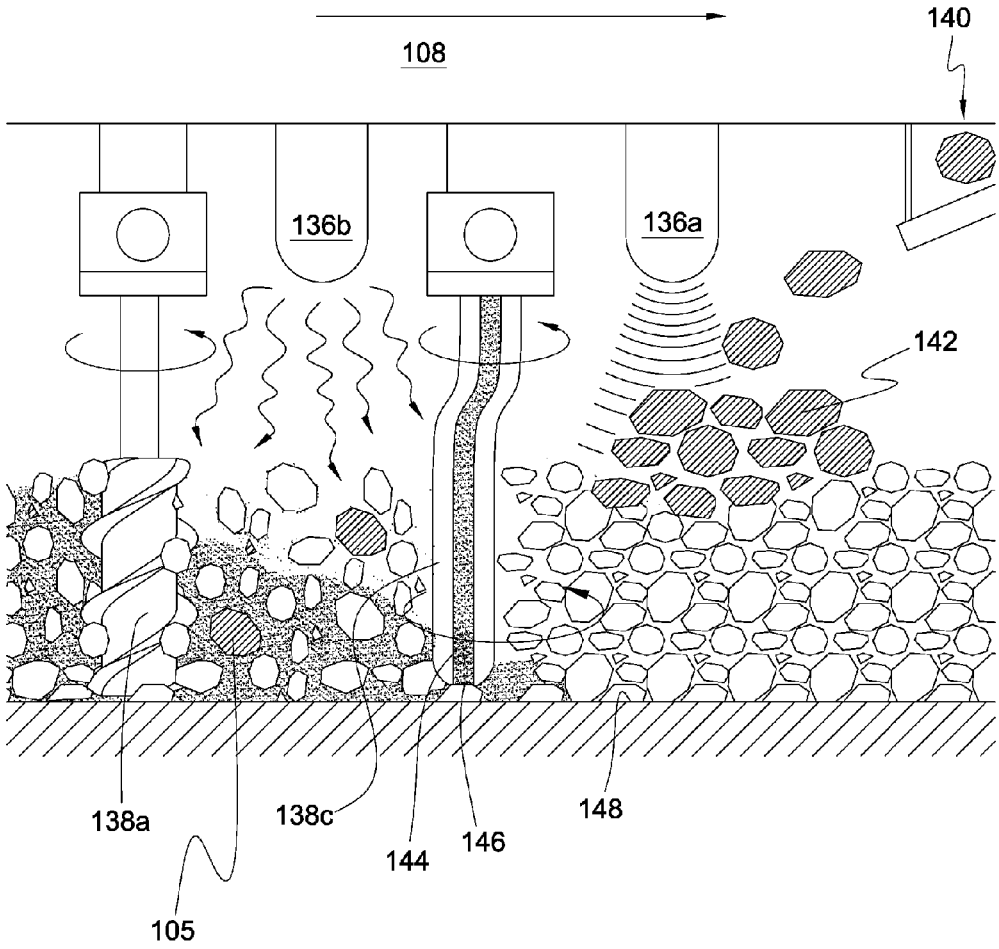
FIG. 4 is a side view of another embodiment of an assembly comprising a mixing and heating mechanism in accordance with the invention.

As will become more apparent from the description of FIGS. 3 and 4, the heating and mixing assemblies 108*a*, 108*b* may include a variety of elements to process and manipulate the pavement constituents 105. For example, these elements may include mixing elements to mix the pavement constituents 105, heating mechanisms to apply heat to the pavement constituents 105 as they are mixed by the mixing elements, and dispensing elements to dispense a supply of water, surfactant, polymers, and/or new pavement materials to mix with the pavement constituents 105 extracted from the road surface 107. In selected embodiments, the heating and mixing assemblies 108*a*, 108*b* may optionally include degradation elements to degrade an existing paved surface 107 into smaller fragments or constituent pieces 105. One of ordinary skill in the art will recognize, however, that in other embodiments, the heating and mixing assemblies 108*a*, 108*b* may be used to process and manipulate pavement fragments or constituents 105 previously generated by other road reconstruction equipment. In such embodiments, the apparatus 100 may not include degradation elements.

The apparatus 100 may include one or more compaction elements 110*a*, 110*b*, such as rollers, screeds, or tampers. These compaction elements 110*a*, 110*b* may be used to compact and smooth the mixture of pavement constituents 105 produced by the mixing and heating assemblies 108*a*, 108*b*. Like the heating and mixing assemblies 108*a*, 108*b*, the compaction elements 110*a*, 110*b* may be extended and retracted with respect to each side of the apparatus 100 to allow the compaction elements 110*a*, 110*b* to compact or smooth a surface wider than the apparatus 100. In selected embodiments, the compaction elements 110*a*, 110*b* may be extended and retracted to reflect the position of the heating and mixing assemblies 108*a*, 108*b*. Both the heating and mixing assemblies 108*a*, 108*b* and the compaction elements 110*a*, 110*b* may include extension and retraction mechanisms 112 such as tracks, hydraulic or pneumatic cylinders, or other mechanisms known to those skilled in the art, to extend and retract the assemblies 108*a*, 108*b* and the compaction elements 110*a*, 110*b* with respect to the apparatus 100. In some embodiments, the compaction element may also be heated.

Figure 2:
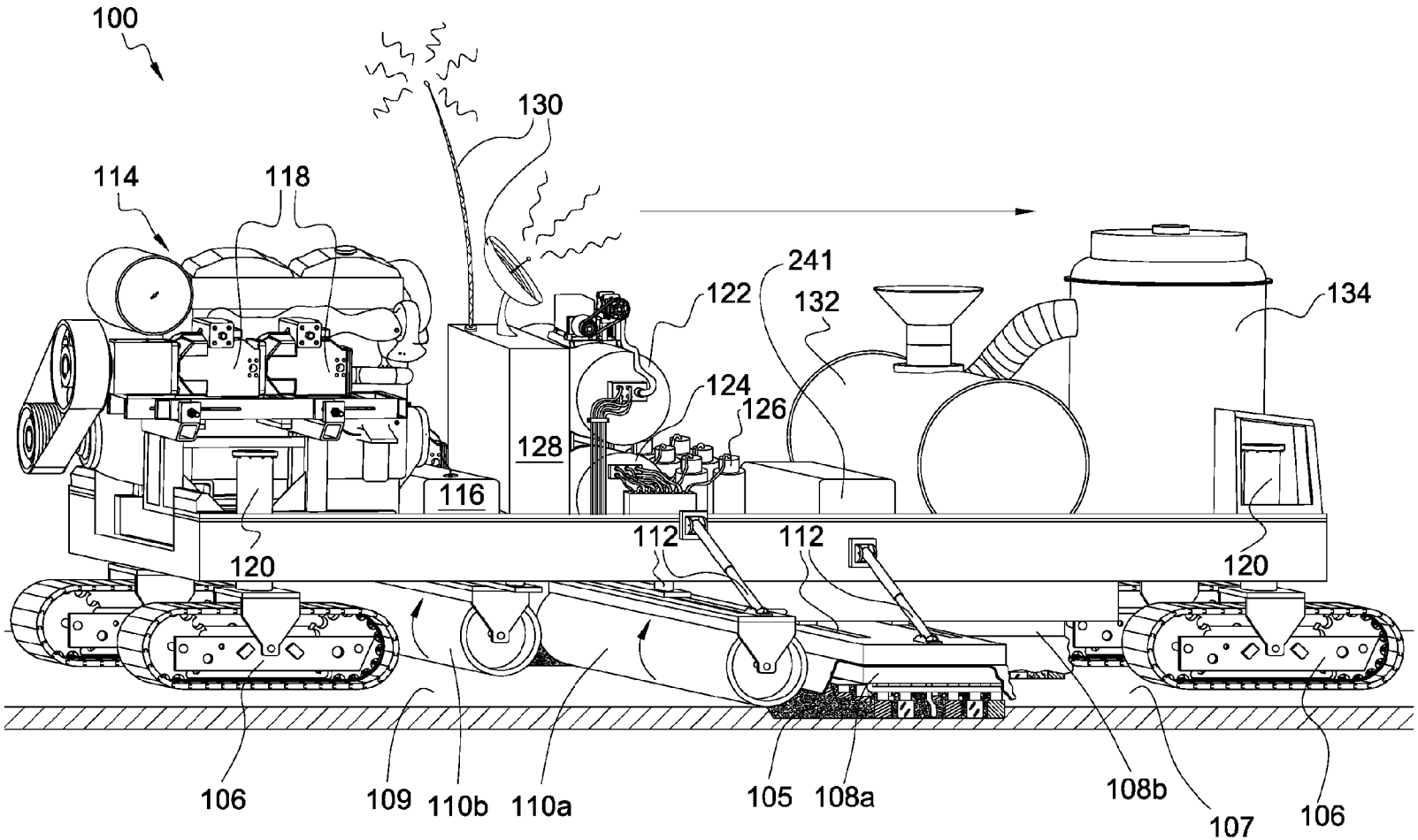
FIG. 2 is a perspective view of one embodiment of an apparatus for recycling pavement in situ, with the outer shroud removed.

Referring to FIG. 2, under the shroud 104, the apparatus 100 may include a variety of components to perform various features and functions. For example, in certain embodiments, the apparatus 100 may include an engine 114, such as a diesel or gasoline engine, to power the apparatus 100. The engine 114 may receive fuel from a fuel tank 116. In certain embodiments, the engine 114 may be used to drive one or more hydraulic pumps 118 which may drive hydraulic motors (not shown) for powering the translation mechanism 106. The hydraulic pumps 118 may also be used to drive one or more hydraulic cylinders 120, connected to the translation mechanism 106, for adjusting the level, slant, or elevation of the apparatus 100, or to compensate for variations in elevation and slope of the underlying road surface. The hydraulic pumps 118 may also be used to power the extension and retraction mechanisms 112 connected to the heating and mixing assemblies 108*a*, 108*b* and the compaction elements 110*a*, 110*b*. Additionally, the hydraulic pumps 118 may be used to power the mixing, dispensing, and degradation elements, as will be described with respect to FIGS. 3 and 4.

In selected embodiments, the apparatus 100 may include an air compressor 122 to provide pneumatic power or an air supply to the apparatus 100. Similarly, the apparatus 100 may include one or more tanks 124 to store hydraulic fluid and additional hydraulic pumps 126 which may be used to supplement the hydraulic pumps 118 powered by the engine 114. In certain embodiments, the apparatus 100 may include a computer or other electronic equipment 128 to control the apparatus 100, and to communicate with various remote sources, including but not limited to radio, satellite, cellular, Internet, or other sources. In selected embodiments, the computer and electronic equipment 128 may communicate wirelessly with these remote sources by way of one or more antennas 130. Such a system may permit the apparatus 100 to be controlled or monitored remotely, or allow data to be uploaded or downloaded to the apparatus 100, as needed. The apparatus 100 may also take advantage of various control systems used in modern asphalt mills, grinders, and cutters, to provide manual or automated control of the apparatus 100, including but not limited to elevation, speed, steering, cut depth, and leveling controls. These controls may employ various feedback systems and sensors located at a variety of locations around the apparatus 100.

The apparatus 100 may also include at least one container such as a hopper 132 and/or a tank 134. The containers may store rejuvenation or renewal materials that may be mixed with pavement constituents on the road bed 107. The resulting mixture may then be applied to the road bed to create a recycled surface 109. Rejuvenation or renewal materials that may be stored in the hopper 132, tank 134, or both, to be used in a recycling process may include, for example, oil, tar, tarmac, macadam, tarmacadam, asphalt, asphaltum, pitch, bitumen, minerals, rocks, pebbles, gravel, sand, polyester fibers, Portland cement, petrochemical binders. Electronic 241 may control a heating element internal to the tank 134 and/or hopper 132 for heating the pavement rejuvenation material. In some embodiments a surfactant may be added with the rejuvenation or renewal materials. It is believed that the surfactant may help reduce the surface tension of oils and help promote mixing. Other rejuvenation materials or renewal materials may foam, which may also aid in pavement recycling process. In selected embodiments, the hopper 132 may be used to store dry materials, such as rocks and gravel, and the tank 134 may be used to store liquids, such as oil or tar.

Referring to FIG. 3, one contemplated embodiment of a heating and mixing assembly 108 is illustrated. Various details, such as the extension and retraction mechanisms 112 illustrated in FIGS. 1 and 2, have been omitted in this example for sake of simplicity. As illustrated, a heating and mixing assembly 108 in accordance with the invention may include a heating mechanism 136 and one or more mixing elements 138*a-c*. The heating mechanism 136 may be positioned substantially above or adjacent to the mixing elements 138*a-c* in order to apply heat to the pavement constituents 105 as they are mixed by the mixing elements 138*a-c*. By heating and mixing the pavement constituents 105 simultaneously, much higher temperatures may be applied to the to pavement constituents 105 without burning, damaging, or destroying asphalt, tar, oil, or other heat-sensitive materials in the pavement. This is because the mixing elements 138*a-c* circulate the pavement constituents such that high temperatures are not directly concentrated on any specific portion of the pavement constituents 105 for more than a brief period of time. As a result, the pavement constituents 105 may be heated more rapidly and uniformly.

The mixing elements 138*a-c* may be adapted to circulate the pavement constituents 105 vertically, horizontally, or a combination thereof, with respect to the road surface. For example, selected mixing elements 138*a*, 138*b* may be adapted to vertically circulate the pavement constituents between the underlying road bed and the surface. In this example, the helical vanes of the mixing elements 138*a*, 138*b* may be used to circulate the pavement constituents in a substantially vertical direction. In other embodiments, a mixing element 138*c* may be used to circulate pavement constituents 105 in a substantially horizontal direction. Here, the curved shaped of the mixing element 138*c* may be used to stir the pavement constituents 105 primarily in the horizontal plane parallel to the road surface. By mixing the pavement constituents 105 both vertically and horizontally, the mixing elements 138*a-c* disperse the heat uniformly through the pavement constituents 105, thereby preventing burning, scorching, or damage thereto.

As mentioned, the ability to apply higher temperatures to the pavement constituents 105 allows more rapid heating of the pavement constituents 105 and allows use of higher temperature heating mechanisms 136. In this example, the heating mechanism 136 is a tubular radiant heater. Nevertheless, any suitable heater may be used to heat the pavement constituents 105 while mixing, including but not limited to a hot air heater, a convection heater, a microwave heater, or a direct flame heater. Although not illustrated in this example, the heating mechanism 136 may also incorporate a blower, or vents, to more effectively direct the heat toward the pavement constituents 105.

The preferred heating mechanism may also comprise the hot pavement rejuvenation material. In this embodiment the pavement rejuvenation material may be preheated before it is dispensed onto the road bed, which may be done in a reducing environment. It is believed that if the hot pavement rejuvenation material is heated to 2000° F. (this may be accomplished in the reducing environment without combustion in either the tank 132 or hopper 134) and then is added to the road bed to constitute 10 percent of the aggregate and the pavement constituents are about 50° F. and constitutes 90 percent of the aggregate then the overall temperature of the mixed aggregate will be about 245° F. One of ordinary skill in the art would recognize how to adjust the temperatures and ratios to achieve their desired temperature. It is believed that for an embodiment as described in this paragraph, an ideal temperature would be within a range of 200° F. to 400° F.

Mixing also allows higher temperatures since the heat will not be focused on just pavement constituents closest to the heating mechanism, but the heat will be more evenly distributed throughout all of the pavement constituents and the pavement rejuvenation materials.

Figure 5:
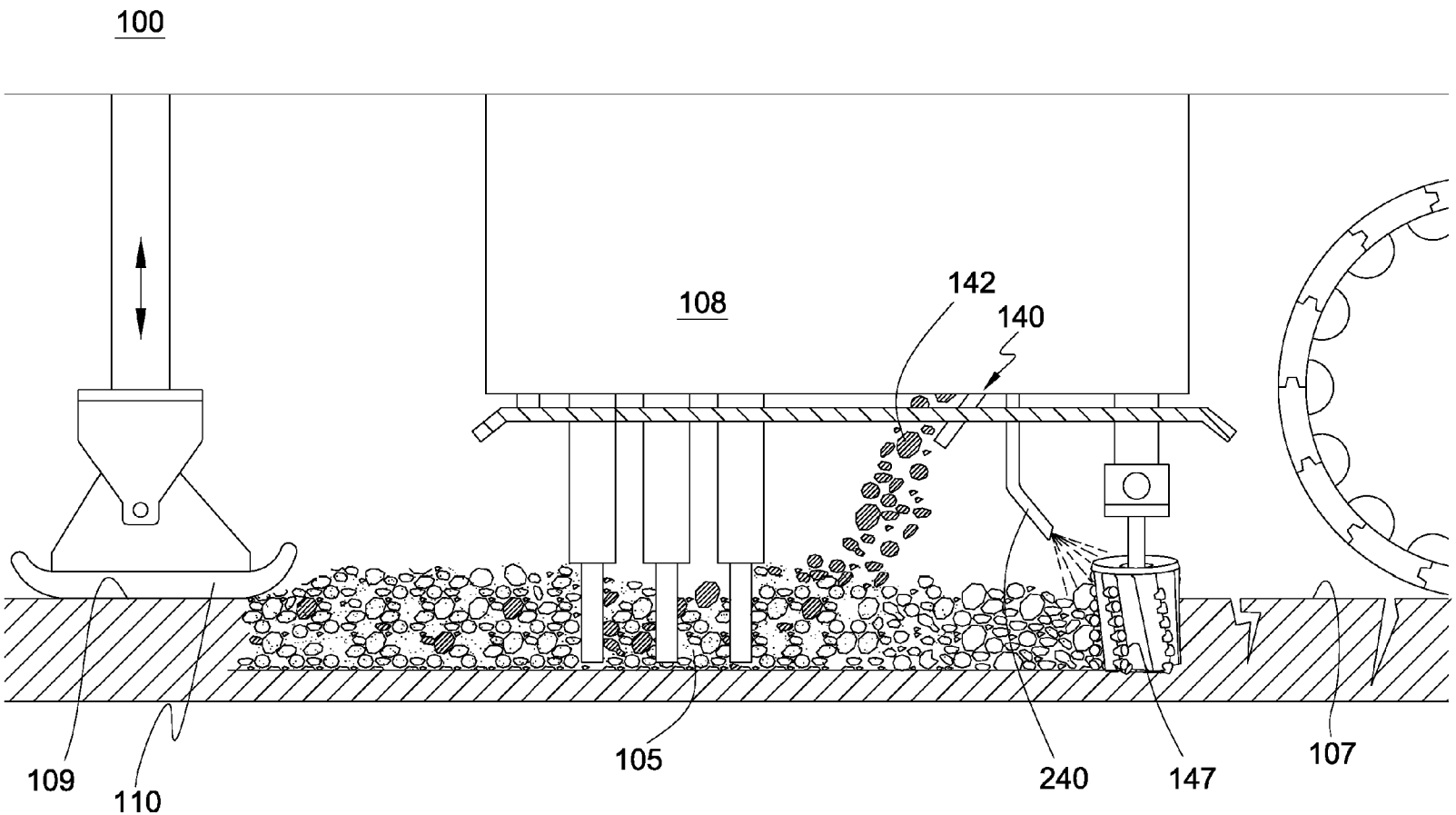
FIG. 5 is a side view of another embodiment of an apparatus for recycling pavement in situ.

The heating and mixing assembly 108 may also include a dispensing element 140 to provide a supply of new pavement materials 142, such as rocks, gravel, or sand to mix with the pavement constituents 105 extracted from the existing road surface 107. In selected embodiments, a mixing element 138*c* may also function as a dispensing element. For example, a mixing element 138*c* may include a central bore 144 for dispensing a material 146 such as oil, tar, asphalt, or the like for mixing with the pavement constituents 105. The dispensing elements 140, 138*c* may communicate with a remote supply of new pavement materials, such as those stored in the hopper 132 or tank 134 as discussed with respect to FIG. 2. In selected embodiments, new pavement materials 142, 146 provided by the dispensing elements 140, 138*c* may be preheated prior to addition to the existing constituents 105. This may aid in heating the resulting mixture and may provide improved bonding. Once the newer materials 142, 146 are mixed with those extracted from the road surface 107, the resulting mixture may be compacted into a new or recycled surface 109 by the compaction element 110. In other embodiments, as shown in FIG. 5, the dispensing element 140 is attached to the vehicle and directs the new pavement materials 142, water, surfactant, and/or polymers to the degradations element 147 and/or the mixing element.

As mentioned, in selected embodiments the heating and mixing assembly 108 may include degradation elements 147 to degrade the paved surface 107. One type of degradation element 147 that may be suitable for use with the present invention is described in U.S. patent application Ser. No. 11/070,411 and entitled "Apparatus, System, and Method for Directional Degradation of a Paved Surface," having common inventors with the present invention, to which this application claims priority and incorporates by reference in its entirety. In this example, the degradation element 147 rotates about an axis substantially normal to the road surface. As the apparatus 100 moves forward, the degradation element 147 cuts or tears into the paved surface 107 using a motion similar to that of a router bit cutting into a wood surface. Nevertheless, one of ordinary skill in the art will recognize that the heating and mixing elements 136, 138*a-c* may function with other types of road cutting and milling equipment, including convention cutting drums rotating about an axis substantially parallel to the road surface. Thus, any type of cutting, milling, or degrading element 147 is within the scope of the present invention.

In certain embodiments, a skirt 149 may be used to surround the heating and mixing elements 136, 138*a-c*, thereby creating a high-temperature or reduction chamber 151. The skirt 149 may be used to retain and focus the heat produced by the heating mechanism 136 on the pavement constituents 105, in addition to reducing dust or other particulates produced from the heating and mixing process. In selected embodiments, an oxidation-depleted (i.e., reducing) gas may also be introduced inside the skirt 149 to reduce the oxidation of the pavement constituents 105, thereby promoting improved bonding between the new pavement materials 142, 146 and materials recycled from the road surface 107. This concept will be described in additional detail in the description associated with FIG. 7.

Referring to FIG. 4, in another contemplated embodiment in accordance with the invention, a heating and mixing assembly 108 may include heating mechanisms 136*a-b*, such as a microwave heater 136*a*, a radiant heater 136*b*, or the like. A first mixing element 138*a* may be effective to circulate the pavement constituents 105 substantially vertically while a second mixing element 138*c* may be effective to stir the pavement constituents 105 substantially horizontally with respect to the paved surface. The second mixing element 138*c* may also include a central bore 144 for dispensing a supply of pavement rejuvenation materials 146, such as tar, oil, or asphaltum. This mixing element 138*c* may reach a depth sufficient to deposit the rejuvenation materials 146 at or near the road bed 148 to promote thorough mixing with the pavement constituents 105 and effective bonding between the recycled surface and the underlying road bed 148. Another dispensing element 140 may be used to supply a quantity of new pavement materials 142, such as rock, gravel, sand to the mixture 105.

Referring to FIG. 5, another embodiment of the present invention is shown. A dispensing element 240 directs pavement rejuvenated material 142 to the degradation elements 147. The rejuvenated materials 142 are mixed immediately into the pavement constituents 105 as the degradation elements 147 degrade the paved surface 107. It is believed that such an embodiment effectively wets at least a majority of the pavement constituent's surface areas. Another dispensing element 140 adds hot pavement constituents to the pavement constituents 105 already residing in the road bed. A plurality of mixing elements 138 follow the degradation elements 147, allowing the heat from the added pavement constituents and pavement rejuvenated materials to be spread evenly throughout the aggregate.

Figure 6:
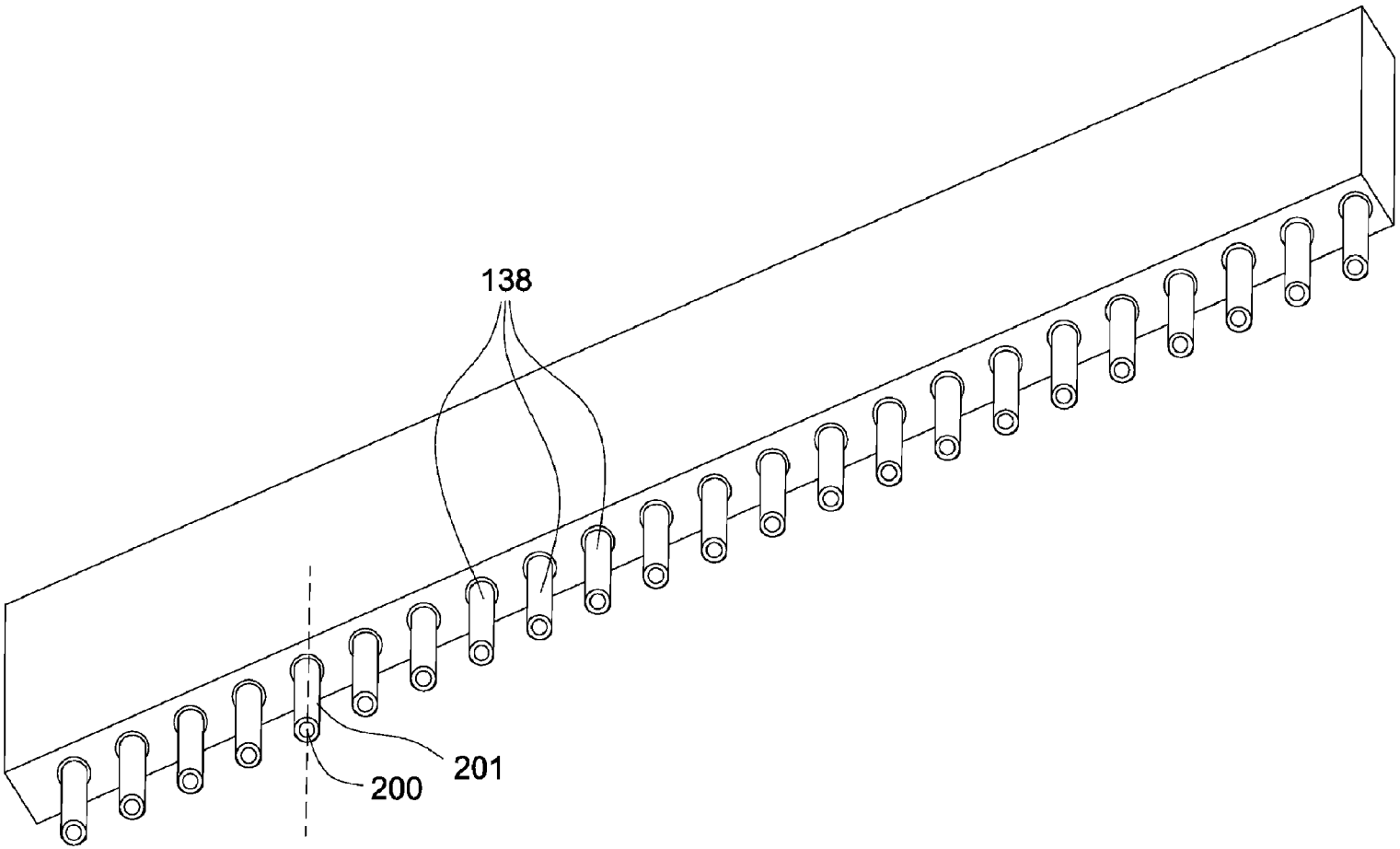
FIG. 6 is a perspective view of an embodiment of a plurality of mixing elements.

FIG. 6 shows an embodiment of a plurality of mixing elements 138 shown detached from the vehicle for clarity. Each mixing element 138 comprises a shaft 201 with a dispensing port 200 located through its center. The dispensing ports 200, may also add rejuvenated materials or new pavement constituents. It may be desirable to dispense hot oil or other pavement rejuvenated materials from the dispensing ports 200 directly on the road bed to promote bonding between the road bed and the pavement constituents 105.

Figure 7:
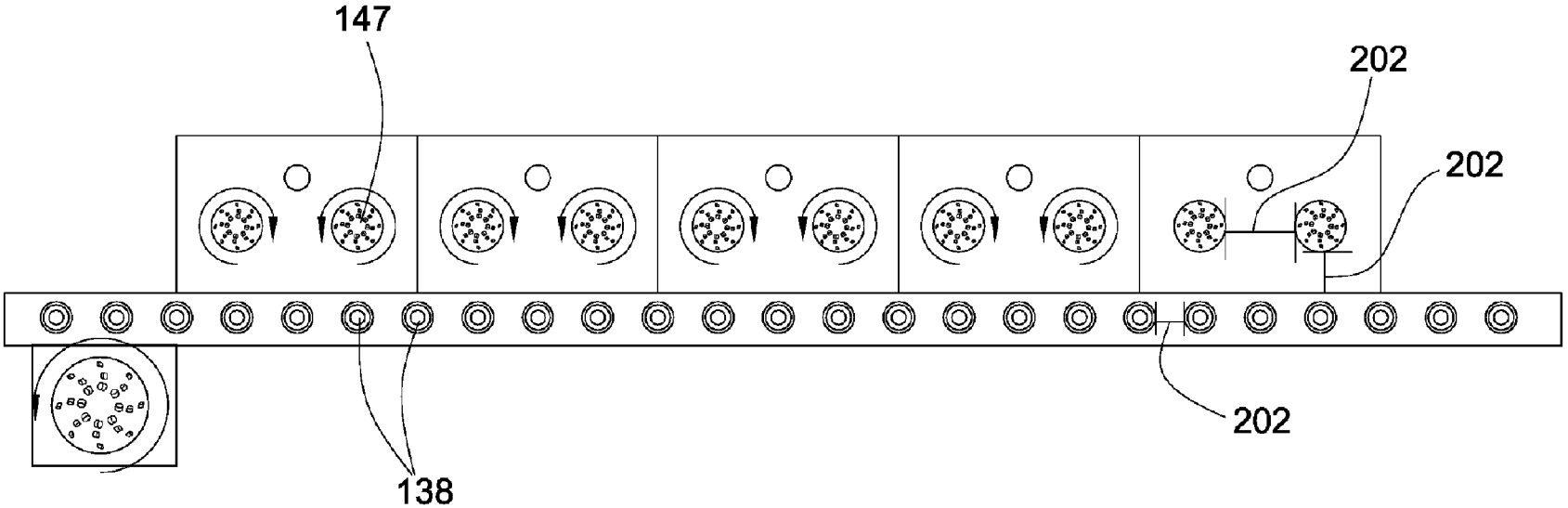
FIG. 7 is a bottom view of an embodiment of degradation and mixing elements.

FIG. 7 shows an embodiment of the degradation element 147 and a plurality of mixing elements 138. In some embodiments of the present invention, the degradation elements 147 are separated by a predetermined distance 202 to control the maximum size a pavement constituent may be. It may be preferable to have the maximum constituent size be ½ inch; in such an embodiment, the degradation elements 147 may be spaced substantially ½ inch apart. Further the mixing element would also need to be spaced ½ apart to allow the maximum constituent size to the pass between them. In accordance with the same embodiment, it may also be desirable to have the mixing elements 138 spaced ½ inch from the degradation element 147; allowing pavement constituents larger than ½ inch to be forced back to the degradation elements 147. The plurality of mixing elements 138 may be stationary, or that may move in a vertical direction, horizontal direction, circular direction, and/or angular direction with respect to the vehicle. It would be obvious to one of ordinary skill in the art to adjust the predetermined distance 202 to achieve a different constituent size. It would also be obvious to one of ordinary skill in the art to modify the cutting depth, the rpm and/or size of the degradation element 147 and/or mixing element 138 to achieve other maximum constituent sizes and/or the distribution of constituent sizes.

Figure 8:
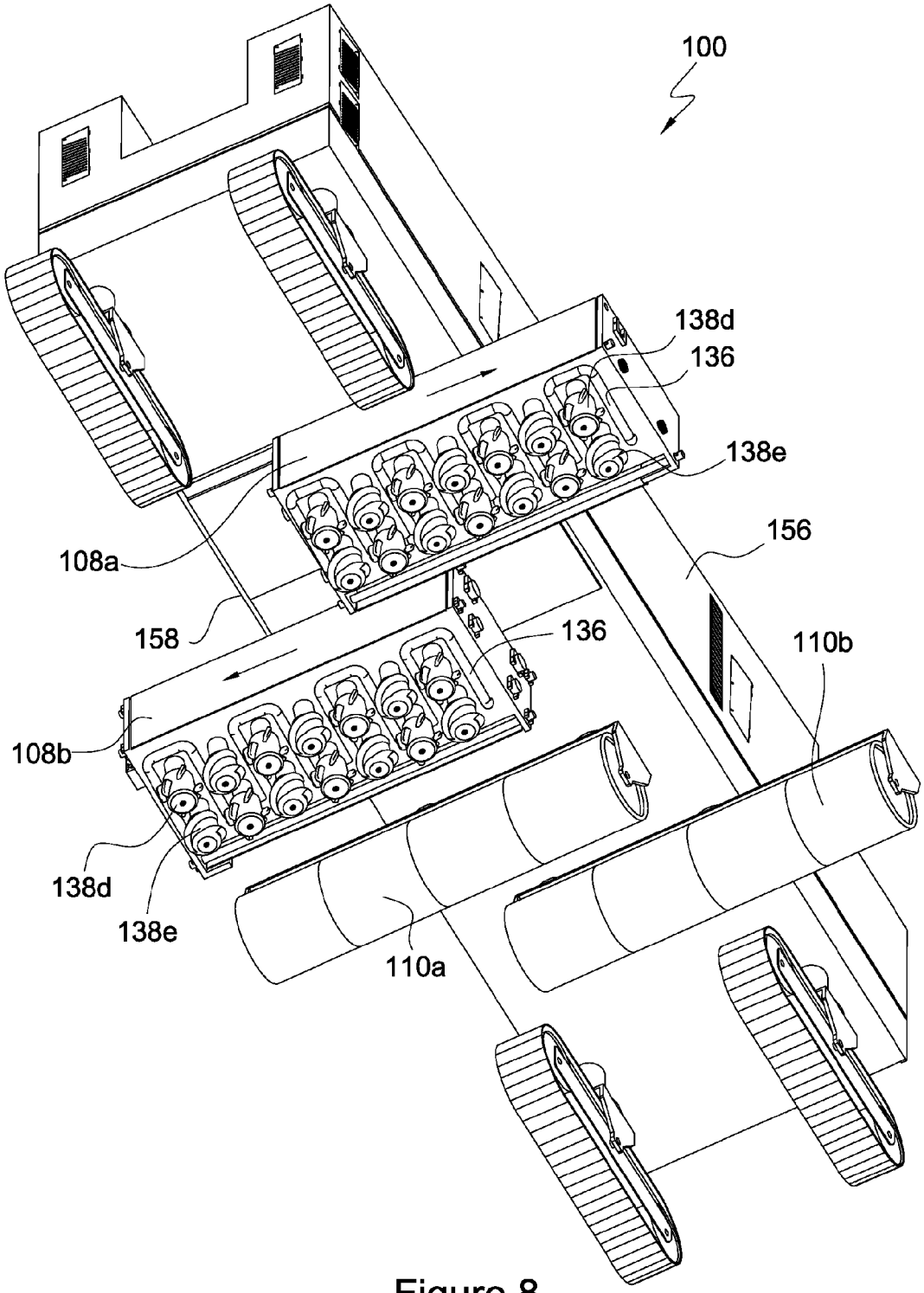
FIG. 8 is a bottom perspective view of another embodiment of an apparatus for mixing and heating pavement materials in situ.
Figure 9:
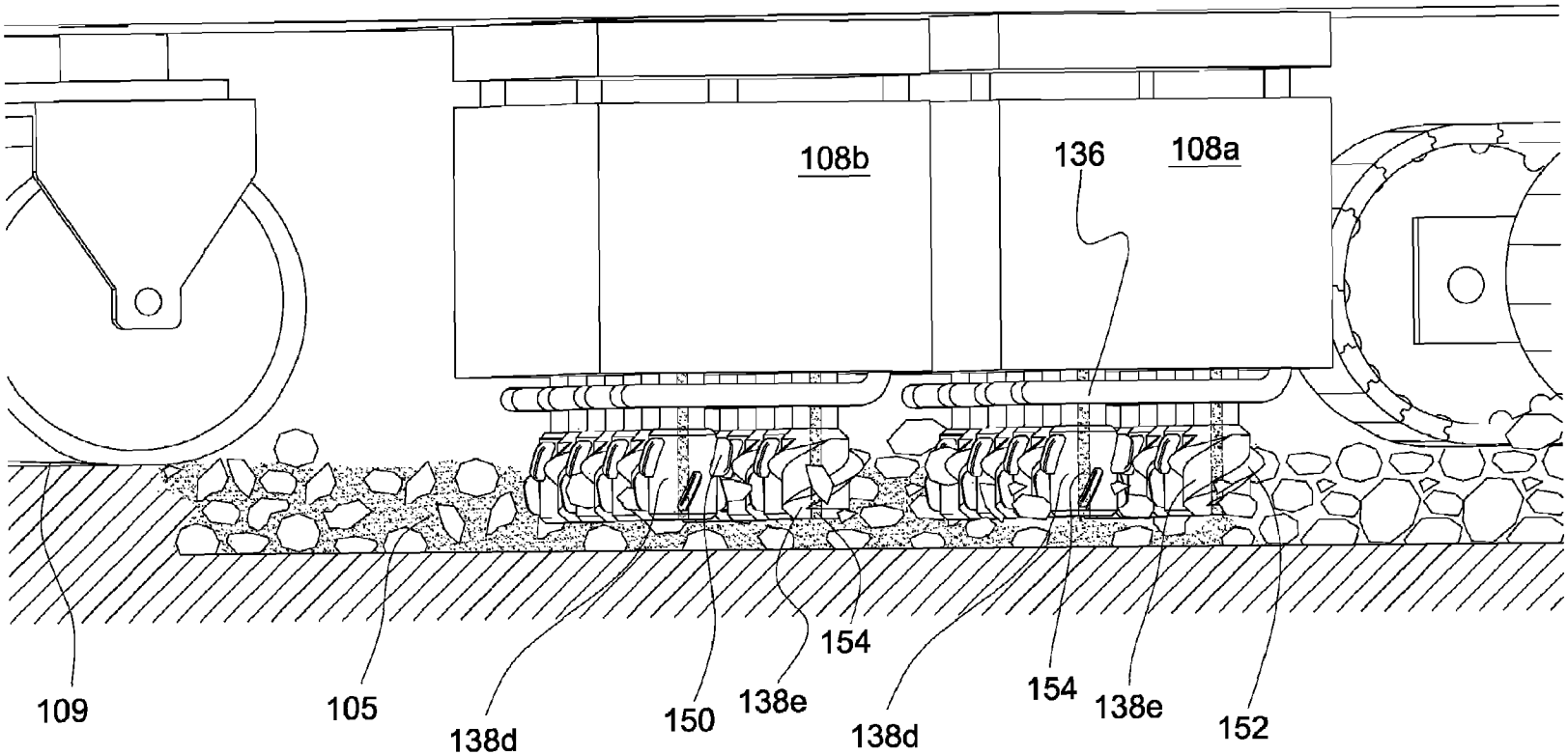
FIG. 9 is a side perspective view of the mixing and heating mechanisms illustrated with the apparatus of FIG. 5.

Referring to FIGS. 8 and 9, another contemplated embodiment of an apparatus 100, comprising heating and mixing assemblies 108*a*, 108*b*, is illustrated. In this embodiment, a first heating and mixing assembly 108*a* may be extended with respect to a first side 156 of the apparatus 100, and a second heating and mixing assembly 108*b* may be extended with respect to a second side 158 of the apparatus 100, thereby enabling the heating and mixing assemblies 108*a*, 108*b* to traverse a pavement area significantly wider than the apparatus 100.

The heating and mixing assemblies 108*a*, 108*b* may include various mixing elements 138*d* to circulate the pavement constituents 105 primarily horizontally with respect to the pavement surface. These mixing elements 138*d* may include agitation members 150 to circulate the pavement constituents 105 substantially horizontally as the mixing elements 138*d* rotate. Other mixing elements 138*e* may circulate the pavement constituents primarily vertically with respect to the pavement surface. These mixing elements 138*e* may, in certain embodiments, include spiral or helical agitation members 152 around the perimeter thereof to circulate the pavement constituents 105 substantially vertically as the mixing elements 138*e* rotate. One of ordinary skill in the art will recognize that by adjusting the angle of the agitation members 150, 152, the mixing elements 138*d*, 138*e* may, in some cases, be adapted to circulate the pavement constituents 105 both horizontally and vertically with respect to the pavement surface. In certain embodiments, the mixing elements 138*d*, 138*e* may include a central bore 154 or other channel 154 for supplying rejuvenation materials to the pavement constituents 105.

A radiant heater 136 may be mounted immediately above or proximate the mixing elements 138*d*, 138*e* to heat the pavement constituents 105, including old and new pavement materials, as the mixing elements 138*d*, 138*e* circulate the pavement constituents 105. A radiant heater 136 may, for example, comprise a tubular structure to circulate hot water, steam, or other heated gases or liquids. Once the pavement constituents 105 are heated, mixed, and rejuvenation materials are added, the resulting mixture may be compacted by compaction elements 110*a*, 110*b*, such as rollers, tampers or screeds. The compaction elements 110*a*, 110*b*, like the heating and mixing assemblies 108*a*, 108*b*, may be extended from each side 156, 158 of the apparatus 100 to follow the heating and mixing assemblies 108*a*, 108*b*.

Figure 10:
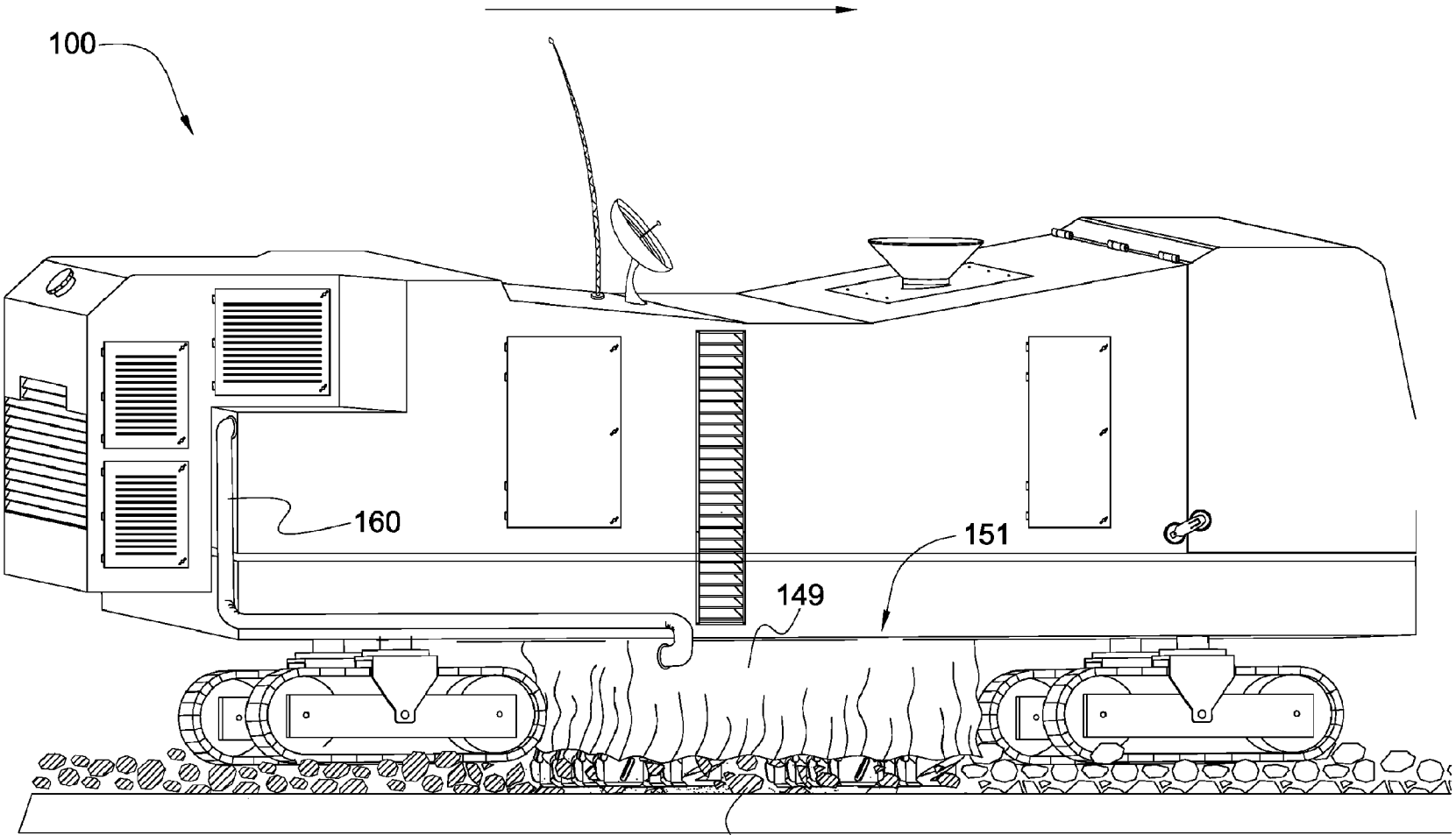
FIG. 10 is a side perspective view of one embodiment of an apparatus comprising a reduction chamber surrounding the heating and mixing elements.

Referring to FIG. 10, in selected embodiments, an apparatus 100 in accordance with the invention may include a skirt 149 to create a high-temperature or reduction chamber 151. The skirt 149 may surround the heating and mixing elements 136, 138*a-c* and may aid in heating the pavement constituents 105 by retaining or focusing heat inside the skirt 149. In selected embodiments, the skirt 149 may be in communication with an oxygen-depleted gas source 160 which may include, for example, an exhaust source such as a fuel-rich exhaust source, or a flame such as a fuel-rich flame. An oxygen-depleted gas may also be directed to the containers shown in FIG. 2, in order to heat the pavement rejuvenation materials to higher temperatures than would otherwise be allowed.

Still referring to FIG. 10, in certain embodiments, exhaust 160 produced by the apparatus 100 may be directed into the chamber 151 to create an oxygen-depleted or reducing atmosphere. This atmosphere may aid in reducing the oxidation of pavement constituents 105 which may serve to create a stronger chemical bond between new and old pavement constituents 105. The oxygen-depleted atmosphere may also reduce the likelihood of combustion or fire within the chamber 151, which may, in turn, enable the application of significantly higher temperatures to the pavement constituents 105. In other embodiments, gases directed into the chamber 151 may also aid in heating the pavement constituents 105. Although illustrated as a fabric-like material, the skirt 149 may be also be embodied as a brush, bellow, or one or more metal or non-metal panels, as illustrated in FIGS. 1 and 2.

As degradation elements 147 degrade a worn paved surface 107, oxygen may bind to the surface of the pavement constituents 105 and interfere with pavement constituents 105 binding to other each other or to pavement rejuvenation materials 142. It will be advantageous to mix the pavement constituents 105 within the reduction chamber 151, so that all of the pavement constituent surfaces become exposed to the reducing environment within the reduction chamber 151 and become reduced.

Figure 11:
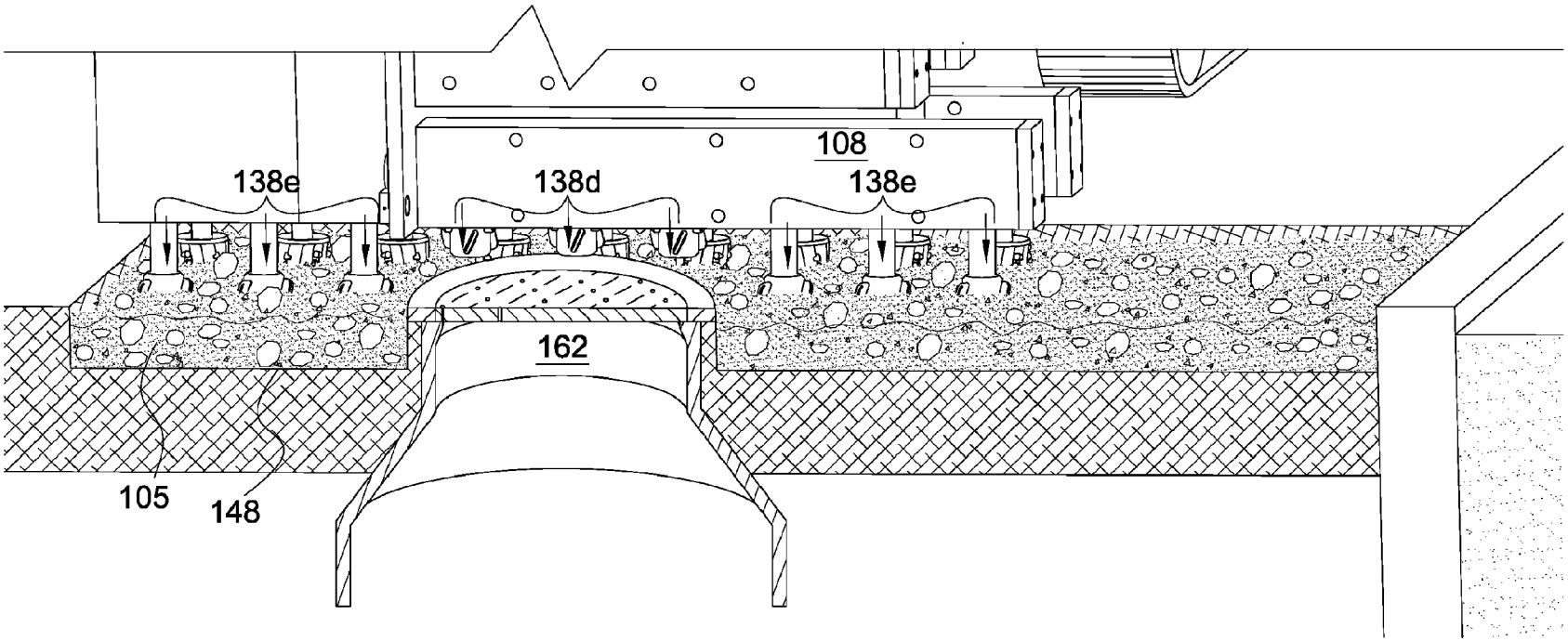
FIG. 11 is a perspective view illustrating mixing elements that may be elevated to avoid obstacles in the roadway.
Figure 12:
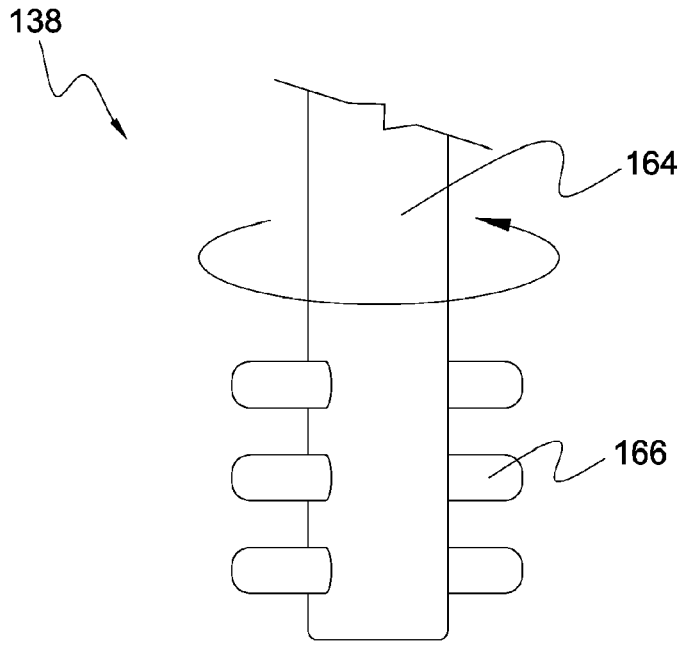
FIGS. 12 through 18 illustrate various embodiments of mixing elements in accordance with the invention.

Referring to FIG. 11, in selected embodiments, mixing elements 138*d-e* of a heating and mixing assembly 108 may be independently elevated with respect to the road bed 148 or surface 148. Thus, the mixing elements 138*d-e* may be elevated to avoid structures such as manholes 162, culverts, or utility lines. For example, one or more mixing elements 138*d* may be elevated to avoid a manhole 162 while others 138*e* may be extended to mix the pavement constituents 105. The mixing elements 138*d-e* may be actuated by hydraulic, pneumatic, or other mechanical means known to those of skill in the art. Similarly, the elevation of the mixing elements 138*d-e* may be controlled manually, such as by an operator, or automatically using sensors and/or feedback systems.

Referring generally to FIGS. 12 through 18, various embodiments of mixing elements 138 for agitating or circulating the pavement constituents 105 are illustrated. Each of these embodiments may agitate, mix, blend, or circulate the pavement constituents 105 in a unique manner and direction, and each may be suitable for use in various different embodiments of the present invention. For example, referring to FIG. 12, in certain embodiments a mixing element 138 may include a rotating shaft 164 comprising one or more agitation members 166 protruding therefrom. The shaft 164 may rotate about an axis substantially normal to the surface of the road. Likewise, the agitation members 166 may travel within a plane substantially parallel to the road surface, thereby circulating the pavement constituents substantially parallel to the road surface.

Figure 13:
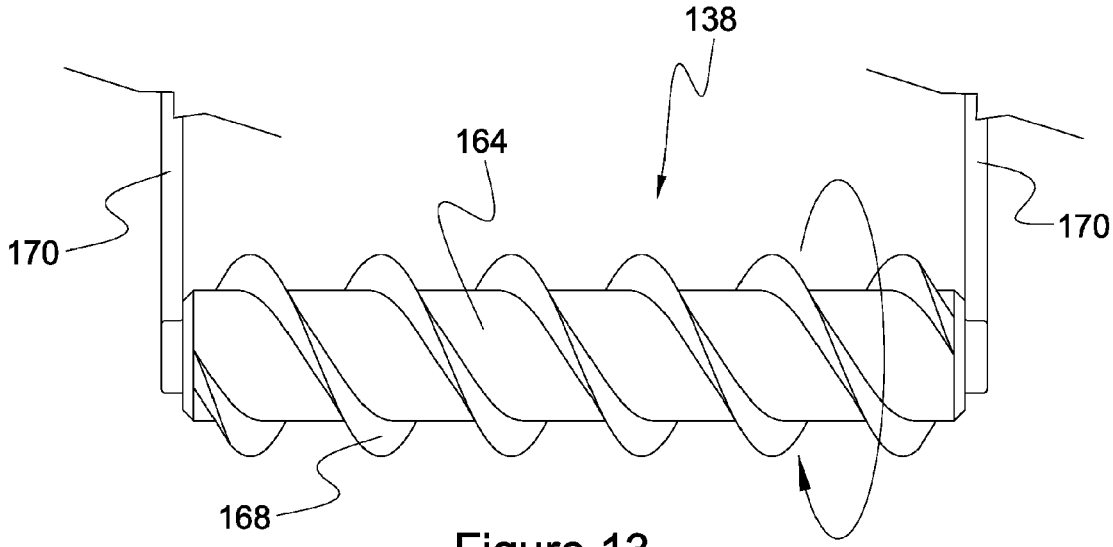

Referring to FIG. 13, in another embodiment, a mixing element 138 may comprise a shaft 164 rotating about an axis substantially parallel to the road surface. In this embodiment, a rigid helix 168 or spiral 168 may be attached to the shaft 164 to circulate pavement constituents 105 in a direction substantially parallel to the shaft 164. Thus, the pavement constituents 105 may circulate in a direction substantially parallel to the road surface. Alternatively, the shaft 164 might include agitation members 166, like those illustrated with respect to FIG. 12, which would circulate the pavement constituents 105 in a direction both perpendicular and parallel to the road surface. In certain embodiments, the shaft 164 may connect to and rotate with respect to one or more arms 170 extending from the apparatus 100 or heating and mixing assembly 108.

Figure 14:
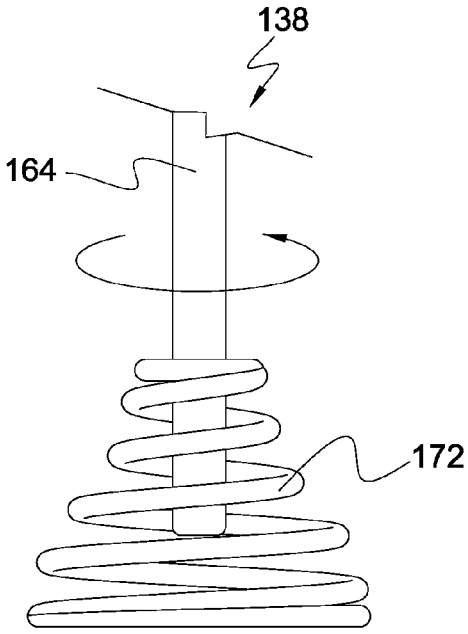

Referring to FIG. 14, in another contemplated embodiment, a mixing element 138 may include a shaft 164 and a helical member 172 attached thereto. The helical member 172 may optionally have a conical shape. As the shaft 164 rotates, the helical member 172 may circulate the pavement constituents 105 in direction both perpendicular and parallel to the road surface.

Figure 15:
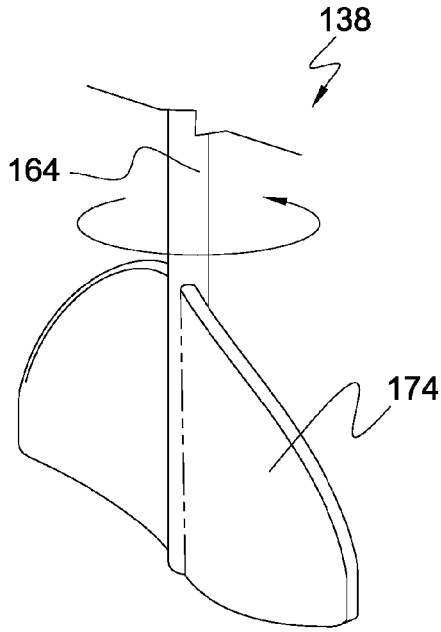
Figure 16:
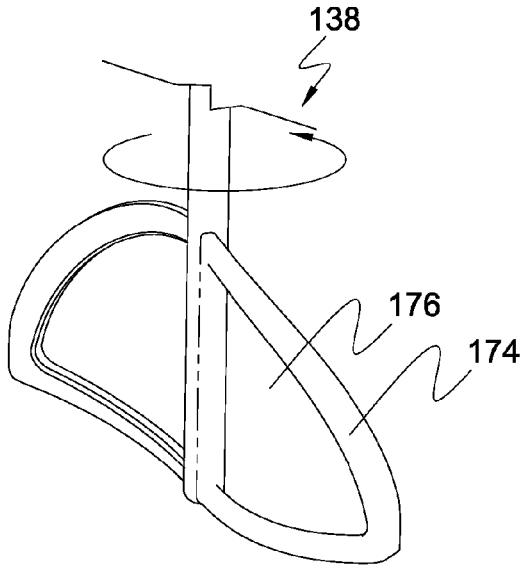

Referring to FIG. 15, in another embodiment, a mixing element 138 may include one or more paddles 174 extending from a shaft 164. The paddles 174 may be flat or curved to circulate the pavement constituents 105 as the shaft 164 rotates. By adjusting the curvature, pitch, or shape of the paddles 174, the paddles 174 may be adapted to circulate the pavement constituents in a direction both perpendicular and parallel to the road surface. In certain embodiments, as illustrated by FIG. 13, an opening 176 may be formed in the paddles 174 to improve or otherwise alter the mixing characteristics of the mixing element 138.

Figure 17:
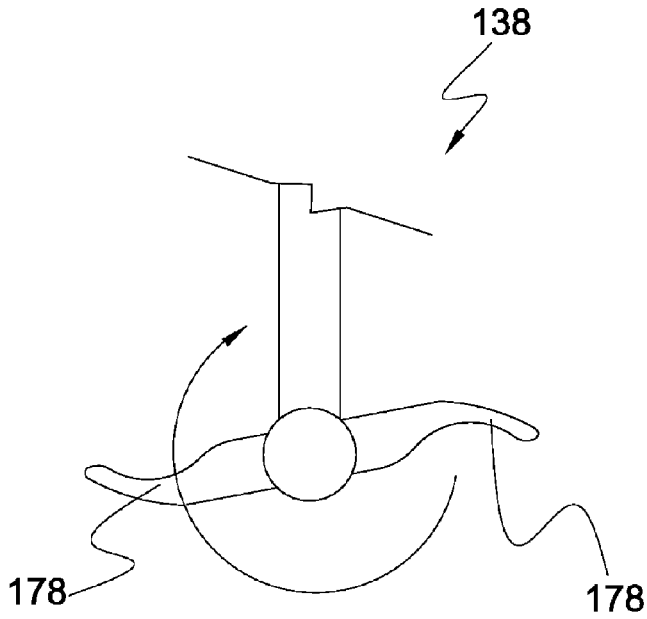

Referring to FIG. 17, in selected embodiments, a mixing element 138 may include one or more members 178 or paddles 178 that rotate about an axis substantially parallel to the road surface. Such an embodiment may be effective to mix or agitate the pavement constituents 105 in a direction both perpendicular and parallel to the road surface.

Figure 18:
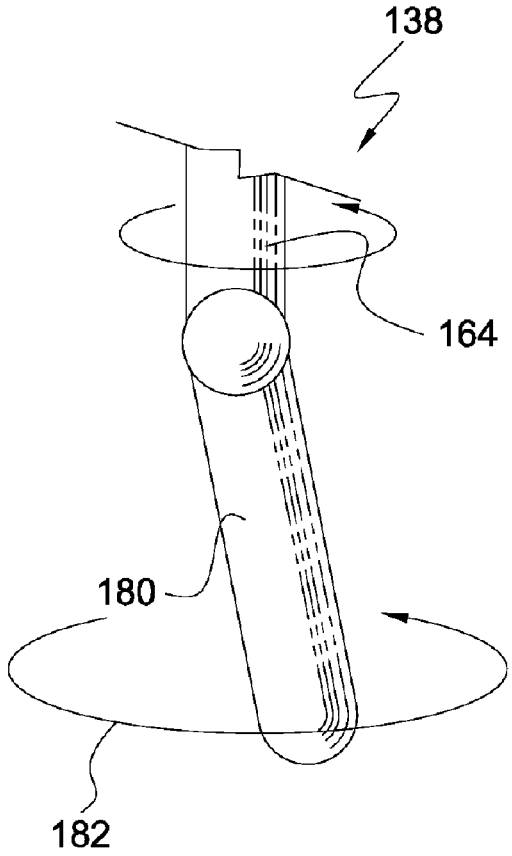

Referring to FIG. 18, in yet another embodiment, a mixing element 138 may include a shaft 164 and a member 180 offset from the shaft 164. Due to the offset, the member 180 may take a substantially circular path 182 as the shaft 164 rotates, thereby mixing and agitating the pavement constituents 105.

Figure 19:
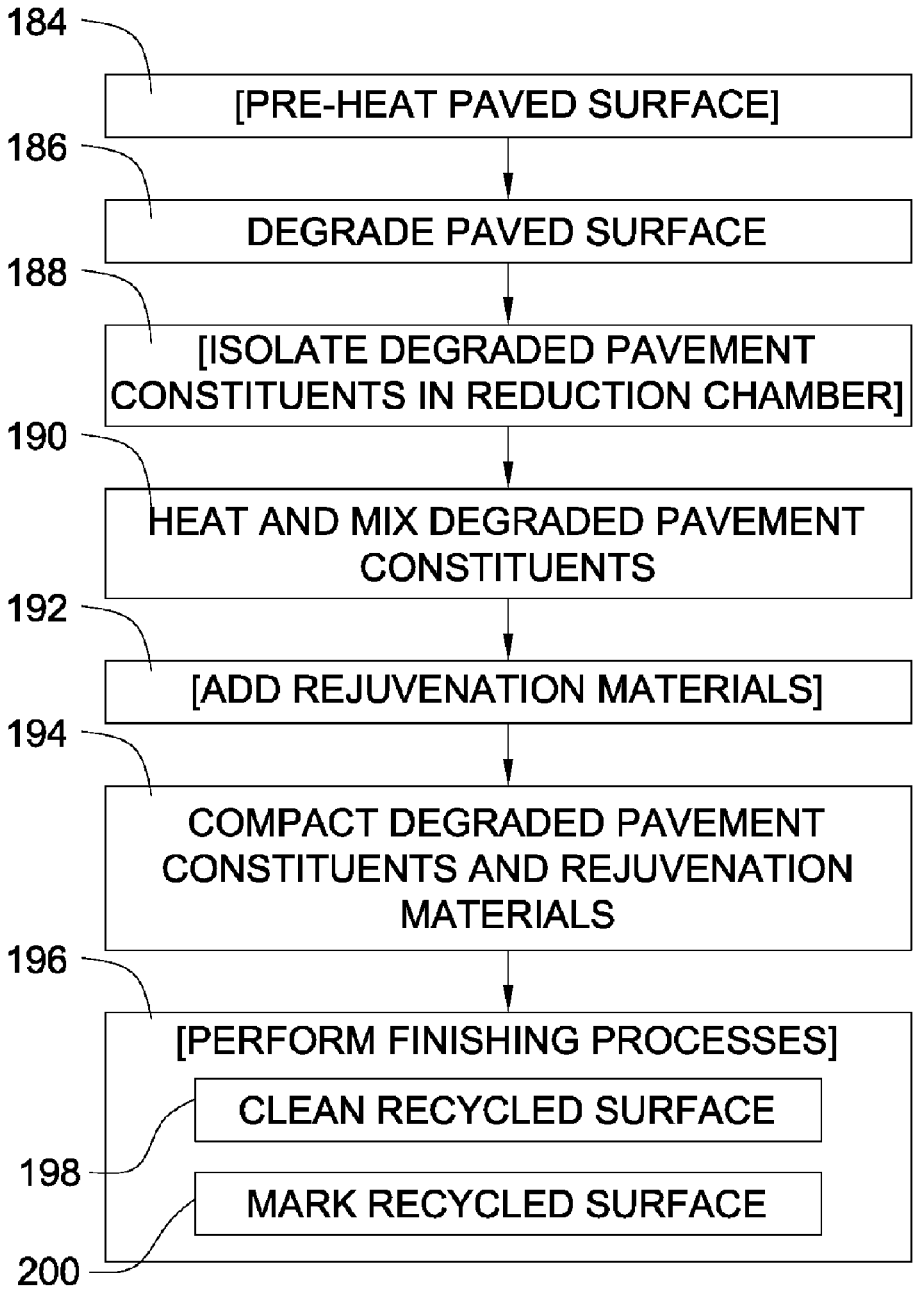
FIG. 19 is a flow diagram of one embodiment of a process for recycling a paved surface in situ.

Referring to FIG. 19, a method for recycling a paved surface in situ in accordance with the present invention may include first degrading 186 a paved surface to produce degraded pavement constituents, heating and mixing 190 the degraded pavement constituents substantially simultaneously in situ to promote thermal bonding therebetween, and compacting 194 the degraded pavement constituents to provide a recycled paved surface. In some embodiments, a method in accordance with the present invention may further comprise pre-heating 184 the paved surface to soften the pavement prior to degradation.

A method for recycling a paved surface in situ may further comprise isolating 188 degraded pavement constituents in a reduction chamber during heating and mixing 190, and adding 192 pavement renewal materials to the degraded pavement constituents to rejuvenate the pavement as needed. Finally, in some embodiments, a method in accordance with the present invention may include performing 196 finishing processes to finish the recycled paved surface. Finishing processes may include, for example, cleaning 198 the recycled paved surface, and/or marking 200 the recycled paved surface as appropriate.

The present invention may be embodied in other specific forms without departing from its essence or essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

What is claimed is:

1. A system for recycling pavement constituents in situ, comprising:

a vehicle for traversing the pavement constituents;

the vehicle comprising a container for storing heated pavement rejuvenation materials;

the vehicle further comprising at least one heating element adapted to heat and preserve the pavement rejuvenation materials above their working temperature;

a dispensing element in communication with the container for dispensing the pavement rejuvenation materials into the pavement constituents;

and a plurality of mixing elements supported by the vehicle;

the mixing elements being adapted to mix in situ the pavement constituents and the heated pavement rejuvenation materials together in such a manner that the pavement constituents are raised to a working temperature, and a compacting element for compacting the resulting mixture of pavement constituents and pavement rejuvenation materials into a new road surface;

wherein at least one of the plurality of mixing elements rotate around an axis substantially normal to a road bed and wherein at least one of the plurality of mixing elements is adapted to move independent of another mixing element of the plurality of mixing elements to avoid obstacles on the road bed.

2. The system of claim 1, wherein the vehicle further comprises at least another heating element supported by the vehicle, the heating element being selected from the group consisting of radiant heaters, hot air heaters, convection heaters, microwave heaters, direct flame heaters, and combinations thereof.

3. The system of claim 1, wherein the dispensing element is formed in the mixing element.

4. The system of claim 1, wherein the mixing element is supported by the vehicle in a reducing environment, the reducing environment being adapted to prevent oxidation of at least one of the pavement constituents and the pavement rejuvenation materials.

5. The system of claim 4, wherein the reducing environment further comprises a reduction source selected from the group consisting of an exhaust gas, a rich-burning flame, or a reducing gas.

6. The system of claim 1, wherein the container on the vehicle is adapted to store the heated pavement rejuvenation materials in a reducing environment.

7. The system of claim 1, wherein the working temperature is 200° F. to 1100° F.

8. The system of claim 1, wherein the system further comprises at least one degradation element supported by the vehicle adapted to degraded a paved surface into the pavement constituents.

9. The system of claim 1, wherein the at least one degradation element is spaced within a predetermined distance from the mixing element, wherein the predetermined distance controls the maximum size of the pavement constituents.

10. The system of claim 1, wherein at least a second dispensing element is in communication with a supply selected from the group consisting of water, polymers, surfactant, and combinations thereof, wherein the dispensing element is adapted to dispense the supply into the pavement constituents.

11. The system of claim 1, wherein the mixing element is selected from the group consisting of mills, degradation elements, rakes, tongs, or drums.

12. The system of claim 1, wherein the mixing element moves independently of the other mixing elements in a vertical direction, horizontal direction, circular direction, and/or angular direction with respect to the vehicle.

13. A method for recycling pavement in situ, the method comprising:

degrading a paved surface to produce pavement constituents;

heating the constituents to a working temperature by simultaneously dispensing heated pavement rejuvenation materials and mixing the pavement constituents with the heated pavement rejuvenation material; and compacting the resulting mixture of pavement constituents and pavement rejuvenation materials into a new road surface;

wherein the mixing is accomplished by a plurality of mixing elements adapted to rotate on an axis normal to a road bed and wherein at least one of the plurality of mixing elements is adapted to move independent of another mixing element of the plurality of mixing elements to avoid obstacles in the road bed.

14. The method of claim 13, wherein a maximum constituent size is controlled by the distance between the plurality of mixing elements and a plurality of degradation elements.

15. The method of claim 13, wherein the heating is performed in a reducing environment.

16. The method claim 13, wherein the heated pavement rejuvenation materials are stored in a reducing environment before they are dispensed and mixed with the pavement constituents.

17. The method of claim 13, wherein the working temperature is between 200° F. to 1100° F.

* * * * *